US009112259B2

(12) United States Patent
Lin

(10) Patent No.: US 9,112,259 B2
(45) Date of Patent: Aug. 18, 2015

(54) MULTIBAND ANTENNA AND WIRELESS COMMUNICATION DEVICE USING SAME

(71) Applicant: FIH (Hong Kong) Limited, Kowloon (HK)

(72) Inventor: Shih-Chieh Lin, Taoyuan (TW)

(73) Assignee: FIH (Hong Kong) Limited, Kowloon (HK)

( * ) Notice: Subject to any disclaimer, the term of this patent is extended or adjusted under 35 U.S.C. 154(b) by 232 days.

(21) Appl. No.: 13/862,852

(22) Filed: Apr. 15, 2013

(65) Prior Publication Data

US 2013/0271341 A1 Oct. 17, 2013

(30) Foreign Application Priority Data

Apr. 17, 2012 (TW) ..... 101113683 A

(51) Int. Cl.

| | |
|---|---|
| ***H01Q 5/00*** | (2006.01) |
| ***H01Q 1/24*** | (2006.01) |
| ***H01Q 9/04*** | (2006.01) |
| ***H01Q 5/371*** | (2015.01) |

(52) U.S. Cl.

CPC ..... *H01Q 5/0093* (2013.01); *H01Q 1/243* (2013.01); *H01Q 5/371* (2013.01); *H01Q 9/0421* (2013.01)

(58) Field of Classification Search

CPC ..... H01Q 1/50
USPC ..... 343/860, 700 MS, 893, 859, 702
See application file for complete search history.

(56) References Cited

U.S. PATENT DOCUMENTS

| | | | | |
|---|---|---|---|---|
| 8,472,908 | B2 * | 6/2013 | Anguera et al. | 455/272 |
| 2008/0062064 | A1 * | 3/2008 | Christie et al. | 343/860 |
| 2010/0156746 | A1 * | 6/2010 | Yung et al. | 343/860 |
| 2010/0289705 | A1 * | 11/2010 | Shtrom et al. | 343/702 |
| 2011/0199272 | A1 * | 8/2011 | He et al. | 343/741 |

* cited by examiner

*Primary Examiner* — Huedung Mancuso
(74) *Attorney, Agent, or Firm* — Novak Druce Connolly Bove + Quigg LLP

(57) ABSTRACT

A multiband antenna, includes a main antenna, a coupling unit, and a matching unit. The main antenna includes a feed portion, a bent portion, a radiation portion, and an extending portion in a same plane. One end of the feed portion is connected to the coupling unit. The bent portion is perpendicularly connected to the other end of the feed portion. The radiation portion is parallel with the feed portion and perpendicularly connected to one end of the bent portion away from the feed portion. The extending portion is connected to one end of the radiation portion away from the bent portion, the coupling unit is parallel with the main antenna and connected to the matching unit, the matching unit feeds signals to and grounds the multiband antenna.

17 Claims, 3 Drawing Sheets

MULTIBAND ANTENNA AND WIRELESS COMMUNICATION DEVICE USING SAME

BACKGROUND

1. Technical Field

The present disclosure relates to multiband communication technology, and particularly to a multiband antenna and wireless communication device using the multiband antenna.

2. Description of Related Art

Wireless communication devices, such as mobile phones, personal digital assistants (PDA), and laptop computers, utilize antennas for receiving/transmitting wireless signals. Many wireless communication devices may receive/transmit wireless signals of different frequencies, thus, requiring the presence of a multiband antenna. The multiband antenna can operate in multiple frequency bands, allowing the wireless communication devices employing the multiband antenna to be compatible with different communication systems.

However, more than two resonance paths are needed in the multiband antenna for covering multiple frequency bands. As a result, a radiation portion of the multiband antenna needs be much larger and has a complicated structure, compromising efforts toward the minimization of wireless communication devices. Therefore, there is room for improvement within the art.

BRIEF DESCRIPTION OF THE DRAWINGS

Many aspects of the present multiband antenna can be better understood with reference to the following drawings. The components in the various drawings are not necessarily drawn to scale, the emphasis instead being placed upon clearly illustrating the principles of the present multiband antenna. Moreover, in the drawings, like reference numerals designate corresponding parts throughout the figures.

DETAILED DESCRIPTION

Figure 1:
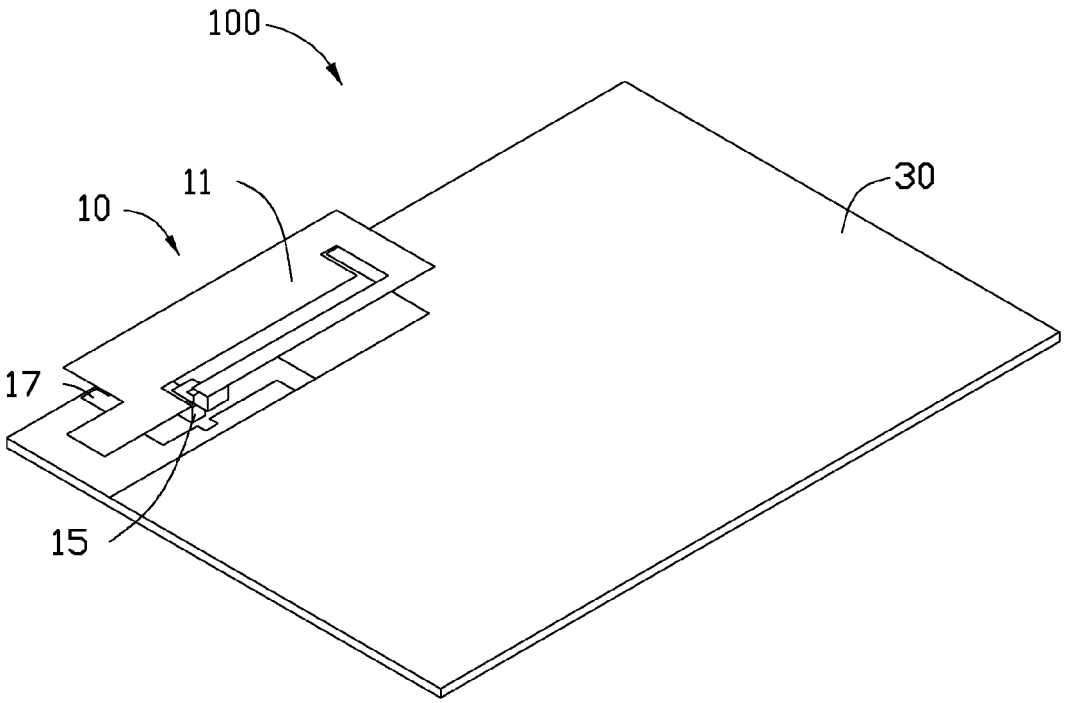
FIG. 1 is a schematic view of a multiband antenna, according to an exemplary embodiment.
Figure 2:
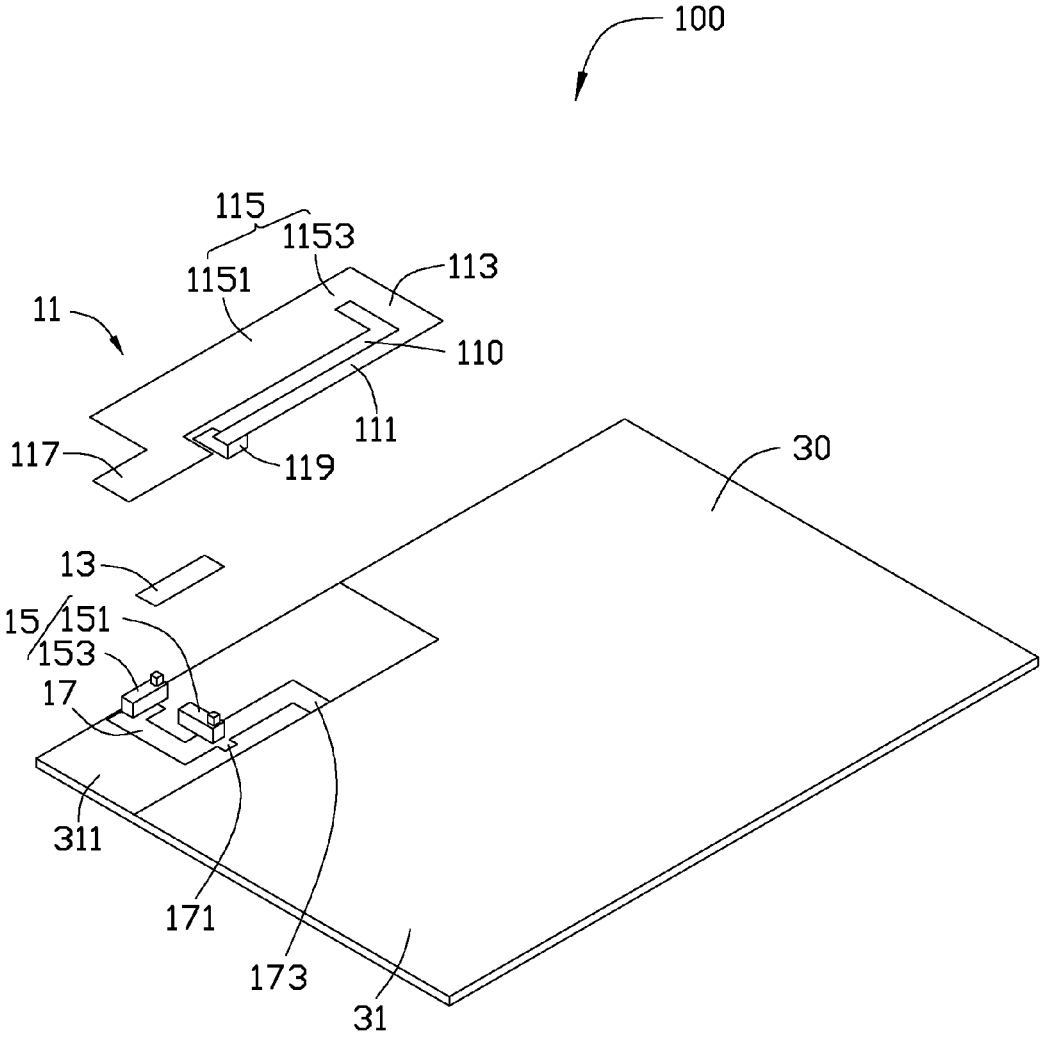
FIG. 2 is an exploded view of the multiband antenna shown in FIG. 1.

FIG. 1 and FIG. 2 schematically show a multiband antenna 100, according to an exemplary embodiment. The multiband antenna 100 is made of conductive sheets, such that a size and profile of the multiband antenna 100 is minimized to be suitable for use in a wireless communication device such as a mobile phone, a personal digital assistant (PDA), or a laptop computer. The conductive sheets can be metal sheets, flexible printed circuits (FPC), or other material. In this embodiment, the multiband antenna 100 is mounted on and electrically connected to a printed circuit board (PCB) 30, and operates in multiple frequency bands.

The multiband antenna 100 includes a main antenna 11, a coupling unit 13, an elastic unit 15, and a matching unit 17. The main antenna 11 is parallel with and overlapping the coupling unit 13. The main antenna 11 and the coupling unit 13 are electrically connected to the matching unit 17 via the elastic unit 15 respectively, and are connected to the PCB 30 via the matching unit 17. The elastic unit 15 includes a first elastic member 151 and a second elastic member 153.

The main antenna 11 is approximately a rectangular planar sheet, defining an L-shaped gap 110. The main antenna 11 includes a feed portion 111, a bent portion 113, a radiation portion 115, and an extending portion 117, which are positioned on a same plane. The feed portion 111 is a thin planar sheet. One end of the feed portion 111 is connected to the first elastic member 151. The bent portion 113 is a thin planar sheet, and is perpendicularly connected to the other end of the feed portion 111 which is away from the end connected to the first elastic member 151. The radiation portion 115 includes a main section 1151 and a protruding section 1153. The main section 1151 is a rectangular planar sheet. The main section 1151 is longer than the feed portion 111, and is narrower than the length of the bent portion 113. The protruding section 1153 connects between the main section 1151 and the bent portion 113, and is positioned on an edge of the main section that is away from the feed portion 111. The extending portion 117 is a rectangular planar sheet and connects to and extends from another edge of the main section 1151 away from the bent portion 113 and near to the feed portion 111. The extending portion 117 is arranged spaced corresponding to the feed portion 111 and in the extending direction of the feed portion 111.

In the present embodiment, the main antenna 11 further includes an L-shaped connecting portion 119. One end of the connecting portion 119 is perpendicularly connected to the feed portion 111. The other end of the connecting portion 119 is parallel with the feed portion 111, and is connected to the first elastic member 151. The connecting portion 119 connects and secures the main antenna 11 to the elastic unit 15 and the PCB 30.

The coupling unit 13 is a rectangular planar sheet. The size of the coupling unit 13 is smaller than the main section 1151. The coupling unit 13 is connected to and secured by the second elastic member 153, and then the coupling unit 13 is connected to the PCB 30 via the second elastic member 153. The coupling unit 13 is arranged between the main antenna 11 and the PCB 30, parallel with and overlapping the main section 1151.

The first elastic member 151 and the second elastic member 153 are both rectangular blocks. The first elastic member 151 and the second elastic member 153 are arranged spaced on the PCB 30 and connected to the PCB 30 via the matching unit 17. The matching unit 17 is arranged on and connected to the PCB 30 and is used for feeding signals and grounding for the multiband antenna 10. In the present embodiment, the matching unit 17 is approximately an S-shaped planner sheet and includes a feed end 171 and a ground end 173. The ground end 173 is formed at a distal end of the matching unit 17. The feed end 171 protrudes from a middle section of the matching unit 17, parallel with and overlapping the ground end 173. The matching unit 17 is connected to a signal layer (not shown) of the PCB 30 via the feed end 171 and connected to a ground of the PCB 30 via the ground end 173. In the present embodiment, the length of the matching unit 17 is adjustable to regular the impedance matching of the multiband antenna 10.

The PCB 30 includes a ground layer 31 arranged on a surface, an opening 311 defined on one end of the ground layer 31 and a signal layer (not labeled) exposed from the opening 311. The PCB 30 carries the multiband antenna 10 above the opening 311, so the feed end 171 is connected to the signal layer to feed signal accordingly and the ground end 173 is connected to the ground layer 31 to ground the multiband antenna 10 accordingly. In addition, the matching unit 17 can be formed in the opening 311 by insert modeling technology.

When the multiband antenna 10 is working, the main antenna 11 is a low frequency resonance path. Corners between the feed portion 111, the bent portion 113, the radiation portion 115, and the extending portion 117 resonate high frequency multiplication path. The coupling unit 13 is coupled to the main antenna 11 to increase capacitive effects, thus, increasing the frequency range of the multiband antenna 10.

Figure 3:
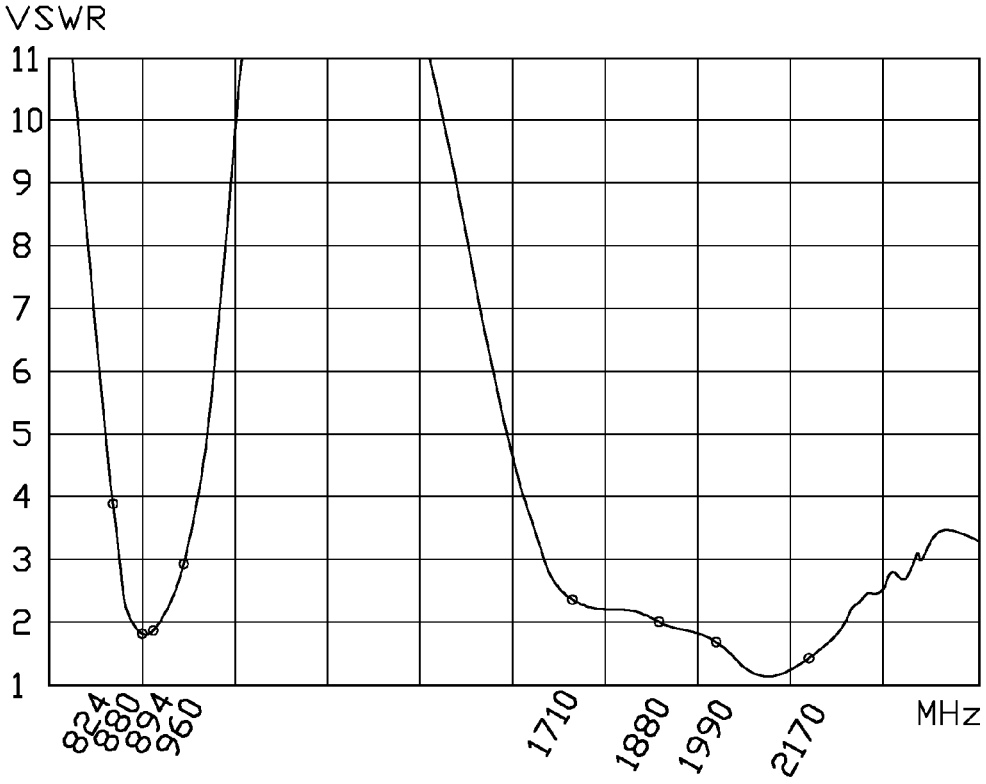
FIG. 3 is a diagram showing a Voltage Standing Wave Ratio (VSWR) measurement of the multiband antenna shown in FIG. 1.

FIG. 3 shows a diagram of a VSWR measurement of the multiband antenna 10. VSWR strengths of the multiband antenna 10 at frequencies of 880 MHz, 894 MHz, 960 MHz, 1.71 GHz, 1.88 GHz, and 1.99 GHz are less than 3, that means the multiband antenna 10 can contain the frequency bands of GSM850/900, GSM1800/1900, and UMTS (1710~2170 MHz).

Summarily, the multiband antenna 10 of the disclosure achieves double broadband operation according to the single path double frequencies resonance of the main antenna 11 and achieves increasing the operation frequency range according to coupling the coupling unit 13 to the main antenna 11. The multiband antenna 10 achieves the communication in several frequency bands without using a plurality of resonance paths. The multiband antenna 10 is simple in structure, coinciding efforts toward the minimization of wireless communication devices.

It is to be further understood that even though numerous characteristics and advantages of the present embodiments have been set forth in the foregoing description, together with details of structures and functions of various embodiments, the disclosure is illustrative only, and changes may be made in detail, especially in matters of shape, size, and arrangement of parts within the principles of the present invention to the full extent indicated by the broad general meaning of the terms in which the appended claims are expressed.

What is claimed is:

1. A multiband antenna, comprising:

a main antenna, including a feed portion, a bent portion, a radiation portion, and an extending portion in a same plane;

a coupling unit; and a matching unit;

wherein one end of the feed portion is connected to the coupling unit, the bent portion is perpendicularly connected to the other end of the feed portion, the radiation portion is parallel with the feed portion and perpendicularly connected to one end of the bent portion that is away from the feed portion, the extending portion is connected to one end of the radiation portion that is away from the bent portion, the coupling unit is parallel with the main antenna and is connected to the matching unit, the matching unit feeds signals to and grounds the multiband antenna.

2. The multiband antenna as claimed in claim 1, further comprising an elastic unit, wherein the elastic unit includes a first elastic member connected between the feed portion and the matching unit and a second elastic member connected between the coupling unit and the matching unit.

3. The multiband antenna as claimed in claim 2, wherein the main antenna further includes a connecting portion connected between the feed portion and the first elastic member.

4. The multiband antenna as claimed in claim 2, wherein the first elastic member and the second elastic member are arranged spaced on the matching unit.

5. The multiband antenna as claimed in claim 1, wherein the extending portion is arranged spaced corresponding to the feed portion and in the extending direction of the feed portion.

6. The multiband antenna as claimed in claim 1, wherein the radiation portion includes a main section and a protruding section, the protruding section is protruded from one end of the main section, the main section is connected to the extending portion, the protruding section is connected between the bent portion and the main section.

7. The multiband antenna as claimed in claim 6, wherein the main section is longer than the feed portion, and is narrower than the length of the bent portion.

8. The multiband antenna as claimed in claim 1, wherein the matching unit includes a feed end and a ground end formed spaced on one edge of the matching unit, the feed end feeds signals for the multiband antenna, and the ground end grounds the multiband antenna.

9. A wireless communication device, comprising:

a PCB, including a ground layer arranged on the surface, the ground layer defining an opening, the opening exposing a signal layer of the PCB; and a multiband antenna, including a main antenna, a coupling unit, and a matching unit, the matching unit is arranged on the opening;

wherein the main antenna includes a feed portion, a bent portion, a radiation portion, and an extending portion in a same plane, one end of the feed portion is connected to the coupling unit, the bent portion is vertically connected to the other end of the feed portion, the radiation portion is parallel with the feed portion and vertically connected to one end of the bent portion away from the feed portion, the extending portion is connected to one end of the radiation portion away from the bent portion, the coupling unit is parallel with the main antenna and connected to the matching unit, the matching unit feeds signals to the multiband antenna from the signal layer and grounds the multiband antenna to the ground layer.

10. The wireless communication device as claimed in claim 9, wherein the matching unit is arranged on the opening by inserted modeling.

11. The wireless communication device as claimed in claim 9, wherein the matching unit includes feed end and a ground end formed spaced on one edge of the matching unit, the feed end is connected to the signal layer and feeds signals for the multiband antenna from the signal layer, the ground end is connected to the ground layer and grounds the multiband antenna to the ground layer.

12. The wireless communication device as claimed in claim 9, further comprising an elastic unit, wherein the elastic unit includes a first elastic member connected between the feed portion and the matching unit and a second elastic member connected between the coupling unit and the matching unit.

13. The wireless communication device as claimed in claim 12, wherein the main antenna further includes a connecting portion connected between the feed portion and the first elastic member.

14. The wireless communication device as claimed in claim 12, wherein the first elastic member and the second elastic member are arranged spaced on the matching unit.

15. The wireless communication device as claimed in claim 9, wherein the extending portion is arranged spaced corresponding to the feed portion and in the extending direction of the feed portion.

16. The wireless communication device as claimed in claim 9, wherein the radiation portion includes a main section and a protruding section, the protruding section is protruded from one end of the main section, the main section is connected to the extending portion, the protruding section is connected between the bent portion and the main section.

17. The wireless communication device as claimed in claim 16, wherein the main section is longer than the feed portion, and is narrower than the length of the bent portion.

* * * * *